US009732662B2

(12) United States Patent
Bockenstette et al.

(10) Patent No.: US 9,732,662 B2
(45) Date of Patent: Aug. 15, 2017

(54) COOLANT CONTROL SYSTEMS AND METHODS FOR TRANSMISSION TEMPERATURE REGULATION

(71) Applicant: GM Global Technology Operations LLC, Detroit, MI (US)

(72) Inventors: Casie M. Bockenstette, Clarkston, MI (US); Eugene V. Gonze, Pinckney, MI (US); William C. Saindon, Goodrich, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 779 days.

(21) Appl. No.: 13/944,134

(22) Filed: Jul. 17, 2013

(65) Prior Publication Data

US 2014/0372008 A1 Dec. 18, 2014

Related U.S. Application Data

(60) Provisional application No. 61/835,118, filed on Jun. 14, 2013.

(51) Int. Cl.
*F01P 7/16* (2006.01)
*F02F 1/24* (2006.01)

(52) U.S. Cl.
CPC ..... *F01P 7/162* (2013.01); *F01P 2025/40* (2013.01); *F01P 2025/44* (2013.01);
(Continued)

(58) Field of Classification Search
CPC .... F01P 7/162; F01P 2025/40; F01P 2025/44; F01P 2060/04; F01P 2060/045; F01P 2060/16; F01P 2025/52; F01P 2007/168; F01P 7/12; F01P 7/14; F01P 7/16; F01P 7/165; F01P 7/167; F01P 9/00; F01P 2060/08; F01P 3/20; F01P 2050/06; F02D 9/04; F02D 2009/0223; F02F 1/243; F02F 1/26; F02F 1/36; F01M 11/0004;
(Continued)

(56) References Cited

U.S. PATENT DOCUMENTS 1,992,568 A * 2/1935 Connor ..... B60H 1/00421 123/142.5 R
2,177,686 A * 10/1939 Bracken ..... F02B 63/04 123/41.1
(Continued)

FOREIGN PATENT DOCUMENTS

CN 102042064 A 5/2011
DE 19955302 5/2001
(Continued)

*Primary Examiner* — Hung Q Nguyen
*Assistant Examiner* — John Bailey

(57) ABSTRACT

A coolant control system of a vehicle includes a pump control module and a coolant valve control module. The pump control module selectively activates a coolant pump. The coolant pump pumps coolant into coolant channels formed in an integrated exhaust manifold (IEM) of an engine. The coolant valve control module selectively actuates a coolant valve that controls coolant flow from the coolant channels formed in the IEM to a transmission heat exchanger based on a first temperature of a transmission and a second temperature of coolant within the integrated exhaust manifold of the engine.

20 Claims, 3 Drawing Sheets

(52) U.S. Cl.
CPC ..... *F01P 2060/04* (2013.01); *F01P 2060/045* (2013.01); *F01P 2060/16* (2013.01); *F02F 1/243* (2013.01)

(58) Field of Classification Search
CPC ..... F01M 11/02; F01M 1/02; F01M 5/001; F01M 5/002; F01M 5/005; F01M 5/02; F02B 29/0443; F02B 47/02; F02G 5/04; F02M 25/0222; F02M 25/12; Y02E 20/14
USPC ..... 123/41.01, 41.05, 41.08, 41.09, 41.12, 123/41.13, 41.2, 41.31, 41.33, 41.44, 123/41.48, 41.56, 41.57, 41.72, 3, 41.29, 123/65 EM, 568.11, 184.33, 184.41, 123/142.5 R, 196 AB, 25 K, 25 Q, 196 R; 701/101, 102; 60/321, 599, 273; 184/6.22
See application file for complete search history.

(56) References Cited

U.S. PATENT DOCUMENTS 5,769,038 A * 6/1998 Takahashi ..... F01P 3/202 123/41.74
5,876,256 A * 3/1999 Takahashi ..... F01P 3/202 440/1
5,950,425 A * 9/1999 Takahashi ..... B63H 20/245 60/321
6,427,640 B1 * 8/2002 Hickey ..... F01M 5/007 123/41.31
6,457,442 B1 * 10/2002 Fuchs ..... F01P 3/20 123/41.29
6,582,263 B1 * 6/2003 Jaeger ..... B63H 21/32 440/88 J
6,772,715 B2 8/2004 Pfeffinger et al.
7,370,611 B1 * 5/2008 White ..... F01P 3/12 123/196 AB
7,398,745 B1 * 7/2008 White ..... F01P 5/14 123/41.01
7,401,578 B2 * 7/2008 Otterstrom ..... F02B 47/02 123/3
8,413,434 B2 4/2013 Prior et al.
8,622,040 B2 * 1/2014 Samie ..... F01N 5/02 123/142.5 R
8,887,496 B2 11/2014 Jarzombek et al.
8,919,298 B2 * 12/2014 Kim ..... F01P 7/165 123/142.5 R
8,978,596 B2 * 3/2015 Glassford ..... F01P 3/20 123/41.05
8,978,613 B2 * 3/2015 Will ..... F01M 5/001 123/196 R
8,997,483 B2 * 4/2015 Zahdeh ..... F01P 3/20 123/41.72
9,188,051 B1 * 11/2015 Zahdeh ..... F01N 5/02
2003/0116105 A1 * 6/2003 Pfeffinger ..... F01P 3/20 123/41.31
2004/0144084 A1 * 7/2004 Hara ..... B60H 1/025 60/288
2006/0096555 A1 * 5/2006 Buck ..... F01P 3/207 123/41.28
2006/0096568 A1 * 5/2006 Buck ..... F02F 7/0031 123/197.4
2007/0209611 A1 * 9/2007 Buck ..... F01L 1/146 123/41.31
2008/0223317 A1 * 9/2008 Shintani ..... F01P 3/12 123/41.05
2010/0197441 A1 * 8/2010 Pursifull ..... F16H 57/0413 475/161
2011/0005477 A1 * 1/2011 Terashima ..... F01K 23/065 123/41.51
2011/0088378 A1 * 4/2011 Prior ..... F01M 5/001 60/320
2012/0006622 A1 * 1/2012 Will ..... F01M 5/001 184/6.22
2012/0048504 A1 * 3/2012 Park ..... B60H 1/00778 165/41
2012/0137993 A1 * 6/2012 Kim ..... F01P 7/165 123/41.11
2012/0198819 A1 * 8/2012 Pursifull ..... F16H 57/0413 60/273
2012/0227686 A1 * 9/2012 D'Anna ..... F02F 1/40 123/41.82 R
2013/0055971 A1 * 3/2013 Brewer ..... F02F 1/24 123/41.82 R
2013/0139491 A1 * 6/2013 Garnepudi ..... F01P 3/20 60/278
2013/0186061 A1 * 7/2013 Jarzombek ..... F01N 5/02 60/273
2013/0305708 A1 * 11/2013 Zahdeh ..... F01P 3/20 60/599
2014/0165567 A1 * 6/2014 Nagai ..... F01N 5/02 60/670
2014/0182810 A1 * 7/2014 Manasek ..... B60H 1/18 165/41
2014/0250889 A1 * 9/2014 Mizoguchi ..... F01K 23/10 60/670

FOREIGN PATENT DOCUMENTS

DE 10161851 6/2003
DE 2010048467 5/2011
DE 102013200854 7/2013
DE 102013208857 11/2013
EP 1101914 5/2001
EP 1319815 6/2003
RU 129056 U1 6/2013

* cited by examiner

COOLANT CONTROL SYSTEMS AND METHODS FOR TRANSMISSION TEMPERATURE REGULATION

CROSS-REFERENCE TO RELATED APPLICATIONS

This application claims the benefit of U.S. Provisional Application No. 61/835,118, filed on Jun. 14, 2013. The disclosure of the above application is incorporated herein by reference in its entirety.

FIELD

The present disclosure relates to vehicles with internal combustion engines and more particularly to systems and methods for controlling engine coolant flow.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

In a feature, a coolant control system of a vehicle includes a pump control module and a coolant valve control module. The pump control module selectively activates a coolant pump. The coolant pump pumps coolant into coolant channels formed in an integrated exhaust manifold (IEM) of an engine. The coolant valve control module selectively actuates a coolant valve that controls coolant flow from the coolant channels formed in the IEM to a transmission heat exchanger based on a first temperature of a transmission and a second temperature of coolant within the integrated exhaust manifold of the engine.

In further features, the coolant valve control module selectively actuates the coolant valve based on at least one of: a first comparison of the second temperature and a first predetermined temperature; and a second comparison of the first and second temperatures.

In still further features, the coolant valve control module actuates the coolant valve to prevent coolant flow from the coolant channels to the transmission heat exchanger when the second temperature is less than a first predetermined temperature.

In yet further features, the coolant valve control module selectively actuates the coolant valve to enable coolant flow from the coolant channels to the transmission heat exchanger when the second temperature is greater than the first predetermined temperature.

In further features, the coolant valve control module actuates the coolant valve to enable coolant flow from the coolant channels to the transmission heat exchanger when the second temperature is greater than the first predetermined temperature and the second temperature is greater than the first temperature.

In still further features, a thermostat valve control module selectively actuates a thermostat valve that controls coolant flow from the engine to a radiator based on the first temperature.

In yet further features, the thermostat control module selectively actuates the thermostat valve based on a comparison of the first temperature and a second predetermined temperature.

In further features, the thermostat valve control module actuates the thermostat valve to enable coolant flow from the engine to the radiator when the first temperature is greater than a second predetermined temperature.

In still further features, the thermostat valve control module selectively maintains the thermostat valve closed to prevent coolant flow from the engine to the radiator when the first temperature is less than the second predetermined temperature.

In yet further features, the second predetermined temperature is greater than the first predetermined temperature.

In a feature, a coolant control method for a vehicle includes: selectively activating a coolant pump that pumps coolant into coolant channels formed in an integrated exhaust manifold (IEM) of an engine; and, based on a first temperature of a transmission and a second temperature of coolant within the integrated exhaust manifold of the engine, selectively actuating a coolant valve that controls coolant flow from the coolant channels formed in the IEM to a transmission heat exchanger.

In further features, the coolant control method further includes selectively actuating the coolant valve based on at least one of: a first comparison of the second temperature and a first predetermined temperature; and a second comparison of the first and second temperatures.

In still further features, the coolant control method further includes actuating the coolant valve to prevent coolant flow from the coolant channels to the transmission heat exchanger when the second temperature is less than a first predetermined temperature.

In yet further features, the coolant control method further includes selectively actuating the coolant valve to enable coolant flow from the coolant channels to the transmission heat exchanger when the second temperature is greater than the first predetermined temperature.

In further features, the coolant control method further includes actuating the coolant valve to enable coolant flow from the coolant channels to the transmission heat exchanger when the second temperature is greater than the first predetermined temperature and the second temperature is greater than the first temperature.

In still further features, the coolant control method further includes selectively actuating a thermostat valve that controls coolant flow from the engine to a radiator based on the first temperature.

In yet further features, the coolant control method further includes selectively actuating the thermostat valve based on a comparison of the first temperature and a second predetermined temperature.

In further features, the coolant control method further includes actuating the thermostat valve to enable coolant flow from the engine to the radiator when the first temperature is greater than a second predetermined temperature.

In still further features, the coolant control method further includes selectively maintaining the thermostat valve closed to prevent coolant flow from the engine to the radiator when the first temperature is less than the second predetermined temperature.

In yet further features, the second predetermined temperature is greater than the first predetermined temperature.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts air and fuel to generate drive torque. The engine includes an integrated exhaust manifold (IEM) that receives exhaust resulting from combustion within cylinders of the engine. The exhaust flows through the IEM and one or more components of an exhaust system before the exhaust is expelled to atmosphere.

A coolant system circulates coolant through various portions of the engine, such as a cylinder head, an engine block, and the IEM. Traditionally, the coolant system is used to absorb heat from the engine, engine oil, transmission fluid, and other components and to transfer heat to air.

Under some circumstances, the transmission fluid may be cold, such as when a vehicle is started. Viscosity of the transmission fluid is inversely related to temperature. Torque losses/loads associated with the transmission fluid increase as viscosity increases.

When an IEM temperature is less than a predetermined temperature, a coolant controller according to the present disclosure may block coolant flow from the IEM to a transmission heat exchanger so coolant can absorb heat from the IEM. When that coolant can warm the transmission fluid, the coolant controller opens a valve to enable coolant flow from the IEM to the transmission heat exchanger. The coolant warmed by the IEM warms transmission fluid flowing through the transmission heat exchanger. Warming the transmission fluid using coolant that is warmed by the IEM may more quickly decrease the torque losses/loads associated with the transmission fluid temperature. Warming the transmission fluid using coolant that is warmed by the IEM may therefore reduce fuel consumption and/or provide one or more other benefits.

Figure 1:
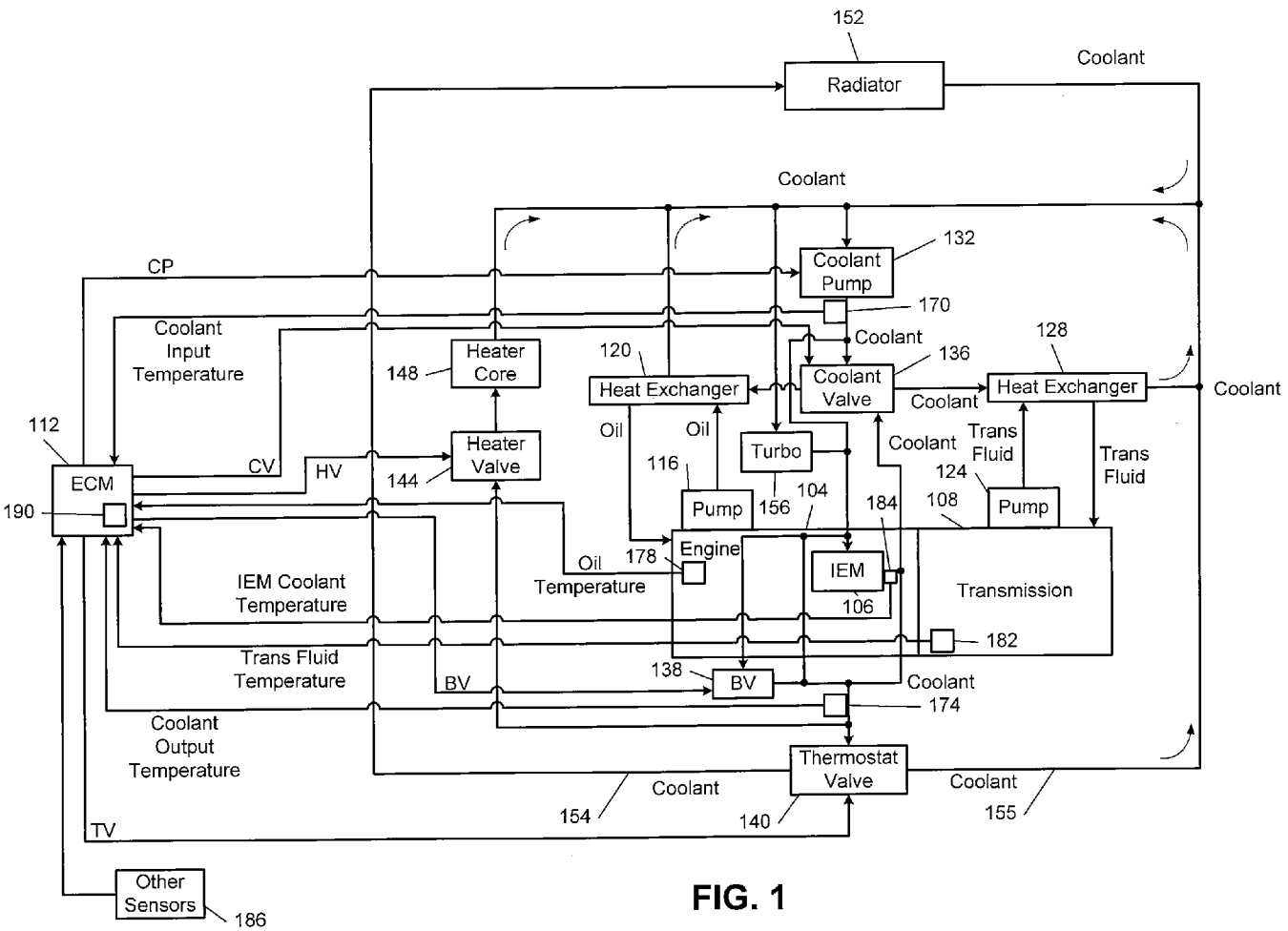
FIG. 1 is a functional block diagram of an example vehicle system according to the present disclosure.

Referring now to FIG. 1, a functional block diagram of an example vehicle system is presented. An engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

Viscosity of the engine oil is inversely related to temperature of the engine oil. That is, viscosity of the engine oil decreases as the temperature increases and vice versa. Frictional losses (e.g., torque losses) of the engine 104 associated with the engine oil may decrease as viscosity of the engine oil decreases and vice versa.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

Viscosity of the transmission fluid is inversely related to temperature of the transmission fluid. That is, viscosity of the transmission fluid decreases as the temperature of the transmission fluid increases and vice versa. Losses (e.g., torque losses) associated with the transmission 108 and the transmission fluid may decrease as viscosity of the transmission fluid decreases and vice versa.

The engine 104 includes a plurality of channels through which engine coolant ("coolant") can flow. For example, the engine 104 may include one or more channels through the head portion of the engine 104, one or more channels through a block portion of the engine 104, and/or one or more channels through the IEM 106. The engine 104 may also include one or more other suitable coolant channels.

When a coolant pump 132 is on, the coolant pump 132 pumps coolant to the channels of the engine 104 and to a coolant valve 136. While the coolant pump 132 is shown and will be discussed as an electric coolant pump, the coolant pump 132 may alternatively be mechanically driven (e.g., by the engine 104) or another suitable type of coolant pump.

The coolant valve 136 may include a two-input, two-output valve or one or more other suitable valves. The two inputs may be: an input for coolant output from the coolant pump 132; and an input for coolant output from the IEM 106. The coolant valve 136 is actuatable to select one of the two inputs at a given time. In other words, the coolant valve 136 is actuatable to receive coolant from either the coolant pump 132 or the IEM 106 at a given time. Selection of one of the two inputs blocks coolant flow into the coolant valve 136 from the other one of the two inputs. The coolant valve 136 is also actuatable to output coolant received at the selected input to the first heat exchanger 120, to the second heat exchanger 128, to both of the first and second heat exchangers 120 and 128, or to block coolant flow out of the coolant valve 136.

A block valve (BV) 138 may regulate coolant flow out of (and therefore through) the block portion of the engine 104. A thermostat valve 140 receives coolant output from the head portion of the engine 104, coolant output from the block valve 138, and coolant output from the IEM 106.

A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle. In various implementations, the heater valve 144 may be omitted, and coolant flow to the third heat exchanger 148 may be regulated via the thermostat valve 140.

The thermostat valve 140 may be referred to as an active thermostat valve. Unlike passive thermostat valves which automatically open and close when a coolant temperature is greater than and less than a predetermined temperature, respectively, active thermostat valves are electrically actuated.

The thermostat valve 140 controls coolant flow out of the engine 104, coolant flow to a fourth heat exchanger 152, and coolant flow to other components, such as back to the coolant pump 132. The fourth heat exchanger 152 may be referred to as a radiator. The thermostat valve 140 may include a one-input, two-output valve or one or more other suitable valves.

Coolant flows from the thermostat valve 140 to the fourth heat exchanger 152 via a first coolant path 154. Coolant bypasses the fourth heat exchanger 152 and flows back to the coolant pump 132 via a second coolant path 155. The thermostat valve 140 may be actuated to output received coolant to the second coolant path 155, for example, when the received coolant is cool or less than a threshold (predetermined) temperature.

Various types of engines may include one or more turbochargers, such as turbocharger 156. Coolant may be circulated through a portion of the turbocharger 156, for example, to cool the turbocharger 156.

A coolant input temperature sensor 170 measures a temperature of coolant input to the engine 104. A coolant output temperature sensor 174 measures a temperature of coolant output from the engine 104. An oil temperature sensor 178 measures a temperature of the engine oil, such as within the engine 104. A transmission fluid temperature sensor 182 measures a temperature of the transmission fluid, such as within the transmission 108. A IEM coolant temperature sensor 184 measures a temperature of coolant within the IEM 106. One or more other sensors 186 may be implemented, such as one or more engine (e.g., block and/or head) temperature sensors, a radiator output temperature sensor, a crankshaft position sensor, a mass air flowrate (MAF) sensor, a manifold absolute pressure (MAP) sensor, and/or one or more other suitable vehicle sensors. One or more other heat exchangers may also be implemented to aid in cooling and/or warming of vehicle fluid(s) and/or components.

As stated above, viscosity of the transmission fluid is inversely related to temperature of the transmission fluid, and losses may decrease as viscosity of the transmission fluid decreases. A coolant control module 190 (see also FIG. 2) controls coolant flow to warm the transmission fluid using coolant output from the IEM 106. Warming the transmission fluid using coolant output from the IEM 106 quickly warms the transmission fluid and therefore decreases losses. While the coolant control module 190 is shown as being implemented within the ECM 112, the coolant control module 190 or one or more portions of the coolant control module 190 may be implemented within another module or independently.

Figure 2:
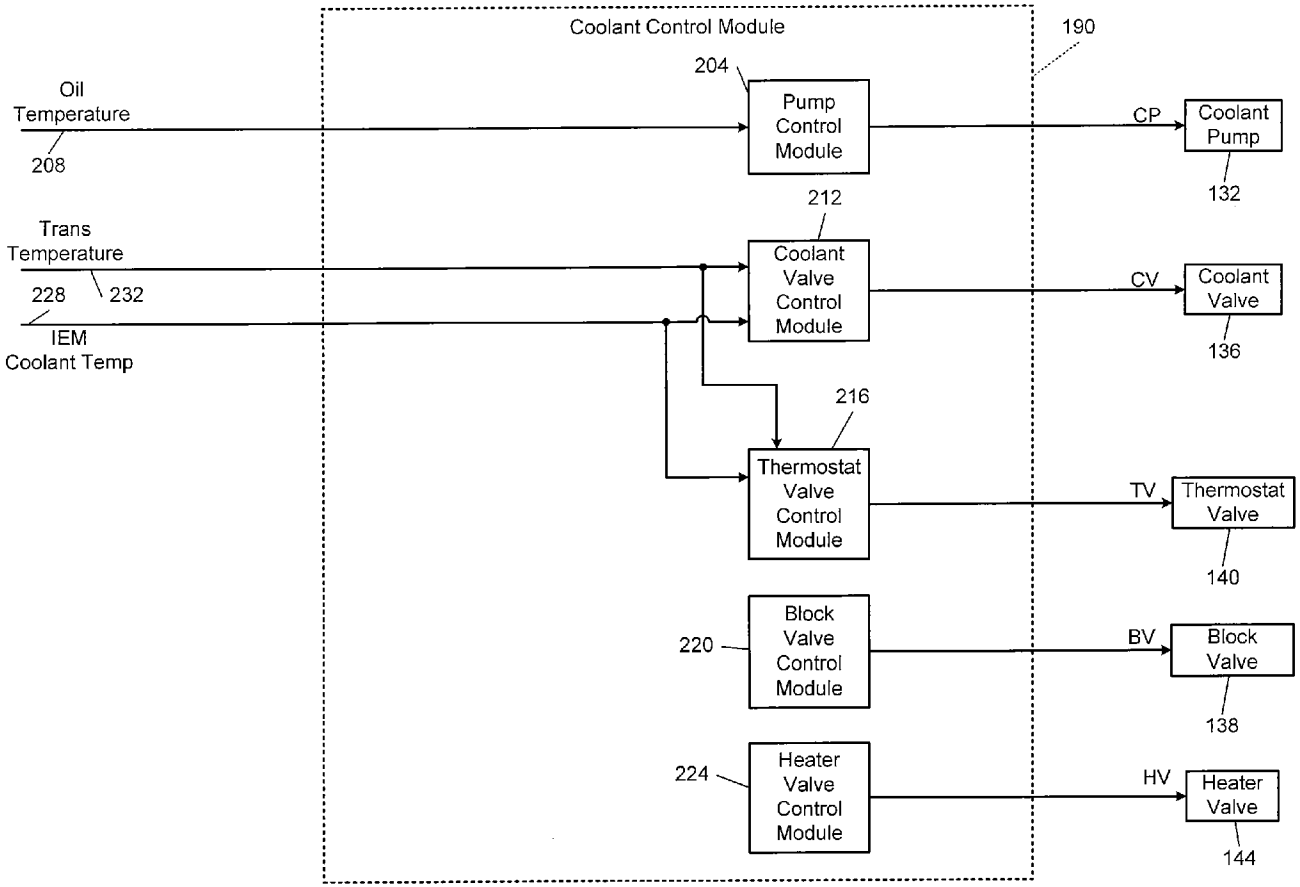
FIG. 2 is a functional block diagram of an example coolant control module according to the present disclosure.

Referring now to FIG. 2, a functional block diagram of an example implementation of the coolant control module 190 is presented. A pump control module 204 may control the coolant pump 132, for example, based on an oil temperature 208 and/or one or more other parameters.

For example, the pump control module 204 may disable the coolant pump 132 when the oil temperature 208 is less than a predetermined temperature. The pump control module 204 may activate the coolant pump 132 when the oil temperature 208 is greater than the predetermined temperature. Disabling the coolant pump 132 until the oil temperature 208 is greater than the predetermined temperature may allow the engine 104 to warm the coolant within the engine 104. If the coolant pump 132 is a mechanically driven coolant pump, the pump control module 204 may be omitted. The oil temperature 208 may be measured using the oil temperature sensor 178 or determined based on one or more other parameters.

A coolant valve control module 212 controls the coolant valve 136. More specifically, the coolant valve control module 212 controls whether the coolant valve 136 outputs coolant to the first heat exchanger 120, the second heat exchanger 128, both the first and second heat exchangers 120 and 128, or neither of the first and second heat exchangers 128.

The coolant valve control module 212 also controls whether the coolant valve 136 receives coolant from the coolant pump 132 or from the IEM 106. In other words, the coolant valve control module 212 also controls whether the coolant pump 132 inputs coolant to the coolant valve 136 or whether the IEM 106 inputs coolant to the coolant valve 136. When the coolant valve 136 outputs coolant received from the coolant pump 132, the coolant valve 136 blocks coolant flow through the IEM 106.

A thermostat valve control module 216 controls the thermostat valve 140. For example, the thermostat valve control module 216 may control whether the thermostat valve 140 outputs coolant to the first coolant path 154 and/or to the second coolant path 155.

A block valve control module 220 may control the block valve 138. For example, the block valve control module 220 may control whether the block valve 138 is open (to allow coolant flow through the block portion of the engine 104) or closed (to prevent coolant flow through the block portion of the engine 104).

A heater valve control module 224 may control the heater valve 144. For example, the heater valve control module 224 may control whether the heater valve 144 is open (to allow coolant flow through the third heat exchanger 148) or closed (to prevent coolant flow through the third heat exchanger 148).

When an IEM coolant temperature 228 is less than a first predetermined temperature, the coolant valve control module 212 actuates the coolant valve 136 to block coolant flow from the IEM 106 to the transmission heat exchanger 128. Coolant within the channels through the IEM 106 may absorb heat from the IEM 106. The IEM 106 receives heat from exhaust resulting from combustion within the engine 104. The first predetermined temperature may be calibratable and may be set based on a temperature above which coolant flowing through the IEM 106 may be used to warm the transmission fluid and, therefore, the transmission 108. For example only, the first predetermined temperature may be approximately 80 degrees Celsius (° C.) or another suitable temperature. The IEM coolant temperature 228 may be measured using the IEM coolant temperature sensor 184 or determined based on one or more other parameters.

When the IEM coolant temperature 228 is greater than the first predetermined temperature and the IEM coolant temperature 228 is greater than a transmission temperature 232, the coolant valve control module 212 actuates the coolant valve 136 to receive coolant output by the IEM 106. The coolant valve control module 212 also actuates the coolant valve 136 to output coolant (received from the IEM 106) to the second heat exchanger 128 when the IEM coolant temperature 228 is greater than the first predetermined temperature and the IEM coolant temperature 228 is greater than the transmission temperature 232. In this manner, coolant can flow from the IEM 106, through the coolant valve 136, to the second heat exchanger 128.

When the IEM coolant temperature 228 is greater than the first predetermined temperature and the IEM coolant temperature 228 is less than the transmission temperature 232, the coolant valve control module 212 actuates the coolant valve 136 to prevent coolant flow from the IEM 106 to the second heat exchanger 128. For example only, the coolant valve control module 212 may actuate the coolant valve 136 to receive coolant from the coolant pump 132 when the IEM coolant temperature 228 is greater than the first predetermined temperature and the IEM coolant temperature 228 is less than the transmission temperature 232. Additionally or alternatively, the coolant valve control module 212 may actuate the coolant valve 136 to output coolant only to the first heat exchanger 120 or to neither of the first and second heat exchangers 120 or 128 when the IEM coolant temperature 228 is greater than the first predetermined temperature and the IEM coolant temperature 228 is less than the transmission temperature 232.

The comparison of the IEM coolant temperature 228 with the transmission temperature 232 ensures that coolant output from the IEM 106 can warm the transmission fluid. The transmission temperature 232 may be, for example, a transmission fluid temperature or another suitable temperature of the transmission 108. The transmission temperature 232 may be measured using the transmission fluid temperature sensor 182, measured using another sensor, or determined based on one or more other parameters. The coolant valve control module 212 may also control the coolant valve 136 based on one or more other parameters and/or for one or more other purposes.

Coolant flowing from the IEM 106 to the second heat exchanger 128 (through the coolant valve 136) warms the transmission fluid within the second heat exchanger 128, and the transmission fluid warms the transmission 108. The warming of the transmission fluid and the transmission 108 decreases losses associated with the transmission 108 and the transmission fluid. The decrease in the losses may decrease fuel consumption.

When the transmission temperature 232 is greater than a second predetermined temperature, the thermostat valve control module 216 actuates the thermostat valve 140 to output coolant to the fourth heat exchanger 152. The second predetermined temperature is greater than the first predetermined temperature. For example only, the second predetermined temperature may be approximately 110° C. or another suitable temperature. The thermostat valve control module 216 may also control the thermostat valve 140 based on one or more other parameters and/or for one or more other purposes.

The fourth heat exchanger 152 cools the coolant so relatively cooler coolant will be provided to the second heat exchanger 128 for cooling the transmission fluid and the transmission 108. The relatively cooler coolant can also be provided to one or more other components of the vehicle for cooling, such as the first heat exchanger 120, the engine 104, and/or the turbocharger 156. While the transmission fluid is shown only as being cooled only via the second heat exchanger 128, the transmission fluid may be additionally or alternatively pumped to one or more other heat exchangers to aid in cooling the transmission fluid, if necessary.

Figure 3:
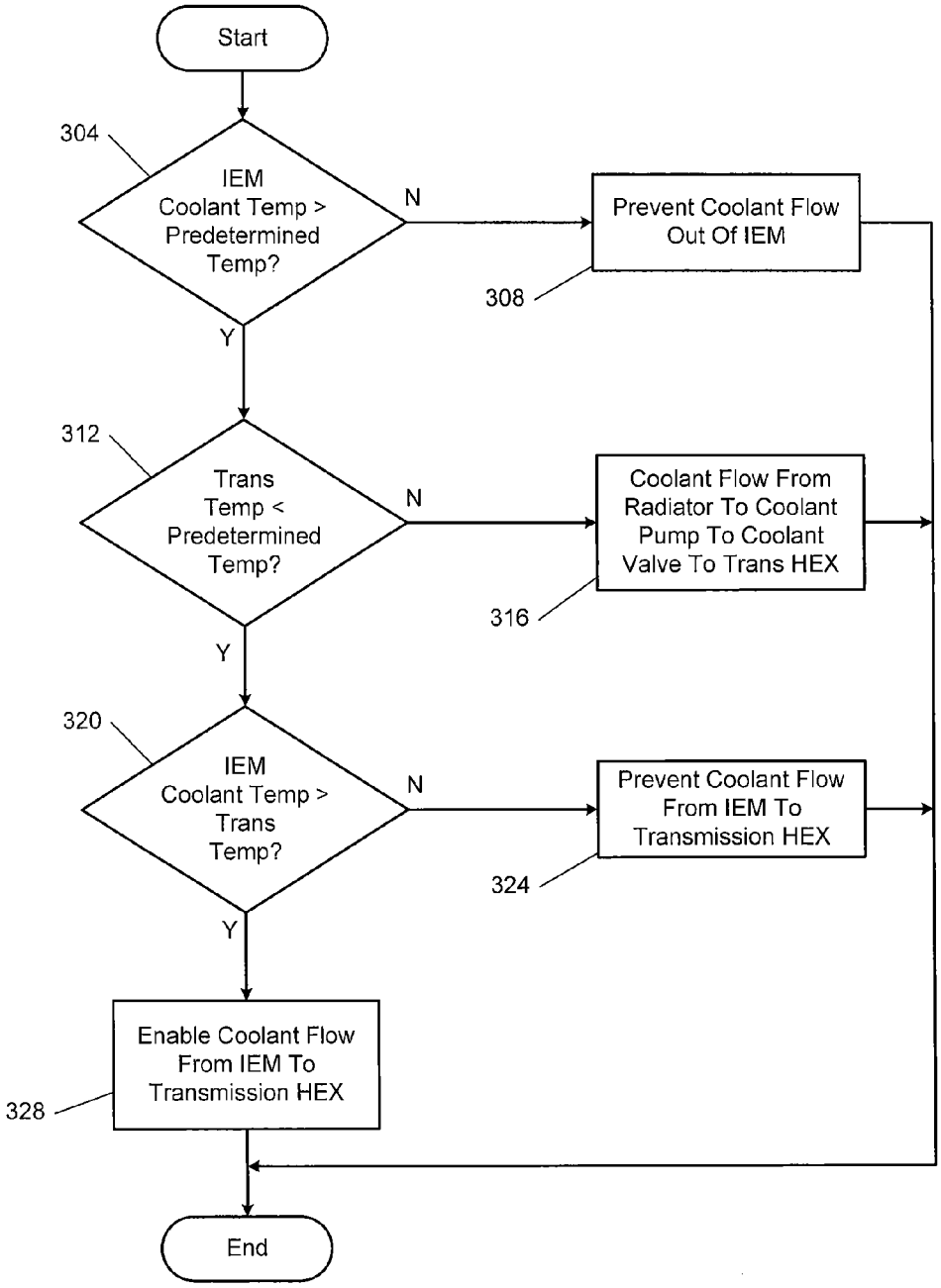
FIG. 3 is a flowchart depicting an example method of controlling coolant flow according to the present disclosure.

Referring now to FIG. 3, a flowchart depicting an example method of controlling coolant flow is presented. Control may begin with 304 when the coolant pump 132 is on. At 304, the coolant valve control module 212 determines whether the IEM coolant temperature 228 is greater than the first predetermined temperature. If 304 is false, the coolant valve control module 212 actuates the coolant valve 136 to block IEM coolant flow through the coolant valve 136 at 308, and control may end. If 304 is true, control continues with 312. For example only, the predetermined temperature may be approximately 80° C. or another suitable temperature above which coolant from the IEM 106 may be considered warm and available to be used to warm the transmission fluid.

At 312, the thermostat valve control module 216 may determine whether the transmission temperature 232 is less than the second predetermined temperature. If 312 is false, coolant that has passed through the fourth heat exchanger 152 and the coolant pump 132 will be allowed to flow through the coolant valve 136 to the second heat exchanger 128 at 316, to cool the transmission fluid, and control may end. For example, the thermostat control valve 216 may actuate the thermostat valve 140 to output coolant to the fourth heat exchanger 152 and/or the coolant valve control module 212 may actuate the coolant valve 136 to enable coolant flow from the coolant pump 132 through the coolant valve 136 to the second heat exchanger 128 at 316. Under some circumstances, the thermostat valve 140 may be actuated to output coolant to the fourth heat exchanger 152 prior to 316. In such circumstances, the coolant valve control module 212 may actuate the coolant valve 136 to enable coolant flow from the coolant pump 132 through the coolant valve 136 to the second heat exchanger 128 at 316. If 312 is true, control may continue with 320. The second predetermined temperature may be greater than the first predetermined temperature and may be approximately 110° C. or another suitable temperature.

At 320, the coolant valve control module 212 may determine whether the IEM coolant temperature 228 may be greater than the transmission temperature 232. If 320 is false, the coolant valve control module 212 actuates the coolant valve 136 to prevent coolant flow from the IEM 106 to the second heat exchanger 128 at 324, and control may end. For example only, the coolant valve control module 212 may actuate the coolant valve 136 to receive coolant from the coolant pump 132 at 324. Additionally or alternatively, the coolant valve control module 212 may actuate the coolant valve 136 to output coolant only to the first heat exchanger 120 or to neither of the first and second heat exchangers 120 or 128 at 324.

If 320 is true, the coolant valve control module 212 actuates the coolant valve 136 to receive coolant output by the IEM 106 at 328. The coolant valve control module 212 also actuates the coolant valve 136 to output coolant (received from the IEM 106) to the second heat exchanger 128 when the IEM coolant temperature 228 at 328, and control may end. Coolant warmed by the IEM 106 may warm the transmission fluid and the transmission 108. While control is shown and discussed as ending, FIG. 3 may be illustrative of one control loop and control loops may be performed at a predetermined loop rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A coolant control system of a vehicle, comprising:

a pump control module that selectively activates a coolant pump, wherein the coolant pump pumps coolant into coolant channels formed in an integrated exhaust manifold (IEM) of an engine; and a coolant valve control module that selectively actuates a coolant valve that controls coolant flow from the coolant channels formed in the IEM to a transmission heat exchanger based on a first temperature of a transmission and a second temperature of coolant within the integrated exhaust manifold of the engine.

2. The coolant control system of claim 1 wherein the coolant valve control module selectively actuates the coolant valve based on at least one of:

a first comparison of the second temperature and a first predetermined temperature; and a second comparison of the first and second temperatures.

3. The coolant control system of claim 1 wherein the coolant valve control module actuates the coolant valve to prevent coolant flow from the coolant channels to the transmission heat exchanger when the second temperature is less than a first predetermined temperature.

4. The coolant control system of claim 3 wherein the coolant valve control module selectively actuates the coolant valve to enable coolant flow from the coolant channels to the transmission heat exchanger when the second temperature is greater than the first predetermined temperature.

5. The coolant control system of claim 3 wherein the coolant valve control module actuates the coolant valve to enable coolant flow from the coolant channels to the transmission heat exchanger when the second temperature is greater than the first predetermined temperature and the second temperature is greater than the first temperature.

6. The coolant control system of claim 3 further comprising a thermostat valve control module that selectively actuates a thermostat valve that controls coolant flow from the engine to a radiator based on the first temperature.

7. The coolant control system of claim 6 wherein the thermostat control module selectively actuates the thermostat valve based on a comparison of the first temperature and a second predetermined temperature.

8. The coolant control system of claim 6 wherein the thermostat valve control module actuates the thermostat valve to enable coolant flow from the engine to the radiator when the first temperature is greater than a second predetermined temperature.

9. The coolant control system of claim 8 wherein the thermostat valve control module selectively maintains the thermostat valve closed to prevent coolant flow from the engine to the radiator when the first temperature is less than the second predetermined temperature.

10. The coolant control system of claim 8 wherein the second predetermined temperature is greater than the first predetermined temperature.

11. A coolant control method for a vehicle, comprising:

selectively activating a coolant pump that pumps coolant into coolant channels formed in an integrated exhaust manifold (IEM) of an engine; and, based on a first temperature of a transmission and a second temperature of coolant within the integrated exhaust manifold of the engine, selectively actuating a coolant valve that controls coolant flow from the coolant channels formed in the IEM to a transmission heat exchanger.

12. The coolant control method of claim 11 further comprising selectively actuating the coolant valve based on at least one of:

a first comparison of the second temperature and a first predetermined temperature; and a second comparison of the first and second temperatures.

13. The coolant control method of claim 11 further comprising actuating the coolant valve to prevent coolant flow from the coolant channels to the transmission heat exchanger when the second temperature is less than a first predetermined temperature.

14. The coolant control method of claim 13 further comprising selectively actuating the coolant valve to enable coolant flow from the coolant channels to the transmission heat exchanger when the second temperature is greater than the first predetermined temperature.

15. The coolant control method of claim 13 further comprising actuating the coolant valve to enable coolant flow from the coolant channels to the transmission heat exchanger when the second temperature is greater than the first predetermined temperature and the second temperature is greater than the first temperature.

16. The coolant control method of claim 13 further comprising selectively actuating a thermostat valve that controls coolant flow from the engine to a radiator based on the first temperature.

17. The coolant control method of claim 16 further comprising selectively actuating the thermostat valve based on a comparison of the first temperature and a second predetermined temperature.

18. The coolant control method of claim 16 further comprising actuating the thermostat valve to enable coolant flow from the engine to the radiator when the first temperature is greater than a second predetermined temperature.

19. The coolant control method of claim 18 further comprising selectively maintaining the thermostat valve closed to prevent coolant flow from the engine to the radiator when the first temperature is less than the second predetermined temperature.

20. The coolant control method of claim 18 wherein the second predetermined temperature is greater than the first predetermined temperature.

* * * * *